US006142758A

United States Patent [19]

Taggett

[11] Patent Number: 6,142,758

[45] Date of Patent: Nov. 7, 2000

[54] ROTARY POSITIVE DISPLACEMENT ENGINE

[75] Inventor: Michael Blake Taggett, Hurricane, Utah

[73] Assignee: Henry Engine Company, Witchita, Kans.

[21] Appl. No.: 09/340,897

[22] Filed: Jun. 28, 1999

[51] Int. Cl.[7] ..... F04C 18/00

[52] U.S. Cl. ..... 418/196; 418/188; 418/109; 418/125; 418/129

[58] Field of Search ..... 418/188, 109, 418/125, 129, 196

[56] References Cited

U.S. PATENT DOCUMENTS

| | | | |
|---|---|---|---|
| 1,095,190 | 5/1914 | Cummins | 418/196 |
| 1,175,140 | 3/1916 | Eisermann | 418/188 |
| 2,382,701 | 8/1945 | Egerdorfer | 418/196 |
| 2,835,204 | 5/1958 | Richards | 418/196 |

*Primary Examiner*—Thomas Denion
*Assistant Examiner*—Theresa Trieu
*Attorney, Agent, or Firm*—William L. Botjer

[57] ABSTRACT

A rotary positive displacement engine includes one or more power rotors, which are acted upon by a pressurized charge of gas, such as steam, and an annular barrier rotor geared for synchronous rotation with the power rotors. The rotors rotate within intersecting cylindrical bores in the engine housing. The power rotors have cylindrical outer surfaces from which opposed vanes extend which are acted upon by the powering charge. The barrier rotor has an outer cylindrical surface, located in close proximity to the cylindrical surface of the power rotors, and ports for delivering the powering charge to the power rotors. The barrier rotor thus forms both a charge delivery mechanism and a barrier between the exhaust ports and the expanding gas powering the engine. Located within the barrier rotor is a stator which has ports in fluid communication with the ports in the barrier rotor when the respective ports are aligned. The location of the barrier rotor is adjustable with respect to the power rotors to permit the clearances between the confronting surfaces of the barrier rotor and the power rotors to be adjusted to extremely tight tolerances under operating conditions, which provides high efficiency operation with very low amounts of contamination of the exhaust gas.

20 Claims, 2 Drawing Sheets

ROTARY POSITIVE DISPLACEMENT ENGINE

BACKGROUND AND SUMMARY OF THE INVENTION

The invention relates to the field of expanders, devices that extract work from pressurized gas while expanding the gas. Specifically, the invention relates to the field of positive displacement rotary expanders, more commonly known as rotary engines. More specifically this invention relates to a rotary steam engine. The invention also relates to the fields of gas compressors and pumps because positive displacement expanders generally can operate in reverse, and to the field of combustion engines having separate compressor, combustor, and expander sections as the expander of the present invention are also applicable to such engines.

Most engines for conversion of heat energy to mechanical energy involve expanding a heated, pressurized, gas by means of a device—an expander—that extracts work from the expansion of the gas. Examples include the traditional high pressure steam engine, wherein hot pressurized steam is expanded through an expander that extracts work, where that expander typically comprises a piston in a chamber or a turbine. Internal combustion engines also require an expansion of heated gas, as they involve a three stage process involving first compressing air, heating the air, and expanding the heated air while extracting work. A typical gas turbine engine (Brayton Cycle) involves separate areas for the compression, heating, and expansion of the gas, while a typical automobile engine (Otto Cycle) utilizes the same piston and cylinder for all three functions.

Expanders may be of the positive displacement type, where gas is admitted to a chamber, one or more walls of the chamber are then allowed to move under the influence of the gas pressure, thereby expanding the volume of the chamber. The moving wall can be called a piston, regardless of the actual shape or configuration of the parts that form the chamber. A positive displacement expander is often more efficient than a turbine at low speeds, while requiring less complex machining and cheaper materials than impulse and reaction turbines. Because of their slow rotation, positive displacement expanders may be less subject to metallurgical creep at high temperatures than are high speed turbines. Positive displacement expanders may also be less subject to erosion from impact of wet steam than are turbines because of the lower impact velocity.

Expanders of the positive displacement type repeatedly expand gas through the same components. Re-using the chamber in this manner requires valves whereby pressurized gas may be admitted to the chamber and expanded gas may be released from the chamber. Typically, a plurality of valves are required, at least one of which admits gas to the chamber and at least one of which releases gas from the chamber. Cylindrical rotary positive displacement expanders are those in which the chamber is formed by a central rotating element that rotates in a cavity. The rotating element is equipped with one or more protrusions or vanes that form the moving wall or piston of the chamber.

The prior art includes an extremely wide variety of rotary positive displacement engines which are testaments to human ingenuity. These devices utilize rotors, valves or other means to deliver the powering charge, such as pressurized steam, to a rotary expansion chamber, to extract work from the charge and to exhaust the spent charge. While such functions are common to all rotary positive displacement engines, the means for carrying out these functions, as embodied in the configuration of the moving parts are limited only by the imagination of the inventors. However many prior rotary positive displacement engine designs are victims of their own ingenuity in that the designs, while apparently functional on paper, are difficult if not impossible, to carry out in metal, as the machining and tolerances required to limit leakage are simply too complex to provide a practical rotary positive displacement engine at a competitive cost. Furthermore, many of the prior engine designs require clearances which are only achievable at ambient temperature, but not in operation at elevated temperatures.

The present invention is directed to a rotary positive displacement engine that overcomes the shortcomings of the prior art which render the previous designs impractical. The first obstacle to practicality that the present invention overcomes is that of complexity. The present invention is based on a design that is simple to manufacture and reproduce in that all of the significant rotating components of the engine are cylindrical. Furthermore, the bores that these components rotate in are also cylindrical. This assures ease of manufacture as a cylinder is the easiest shape to machine.

The second obstacle to practicality that the present design overcomes is the necessity for compromising on the tolerances for the rotating parts. The present design provides that the clearances of the major rotating parts are adjustable at operating temperature, so that very tight clearances can be achieved. This assures the most energy efficient operation. The present invention is applicable to rotary positive displacement engine designs having single or multiple power rotors and barrier rotors, as well as to single or compound operation. The present design is also applicable to low or high pressure operation.

A rotary positive displacement engine in accordance with the present invention includes one or more power rotors, which are acted upon by a pressurized charge of gas, such as steam, and an annular barrier rotor geared for synchronous rotation with the power rotors. The rotors rotate within intersecting cylindrical bores in the engine housing. The power rotors have cylindrical outer surfaces from which vanes extend which are acted upon by the powering charge. The barrier rotor has an outer cylindrical surface, located in close proximity to the cylindrical surface of the power rotors, and ports for delivering the powering charge to the power rotors. The barrier rotor thus forms both a charge delivery mechanism and a barrier between the exhaust ports and the expanding gas powering the engine. Located within the barrier rotor is a stator which has ports in fluid communication with the ports in the barrier rotor when the respective ports are aligned. The location of the barrier rotor is adjustable with respect to the power rotors to permit the clearances between the confronting surfaces of the barrier rotor and the power rotors to be adjusted to extremely tight tolerances under operating conditions which provides highly efficient operation.

BRIEF DESCRIPTION OF THE DRAWINGS

For a better understanding of the invention, reference is made to the following drawings which are to be taken in conjunction with the detailed description to follow in which.

DESCRIPTION OF THE PREFERRED EMBODIMENTS

Figure 1:
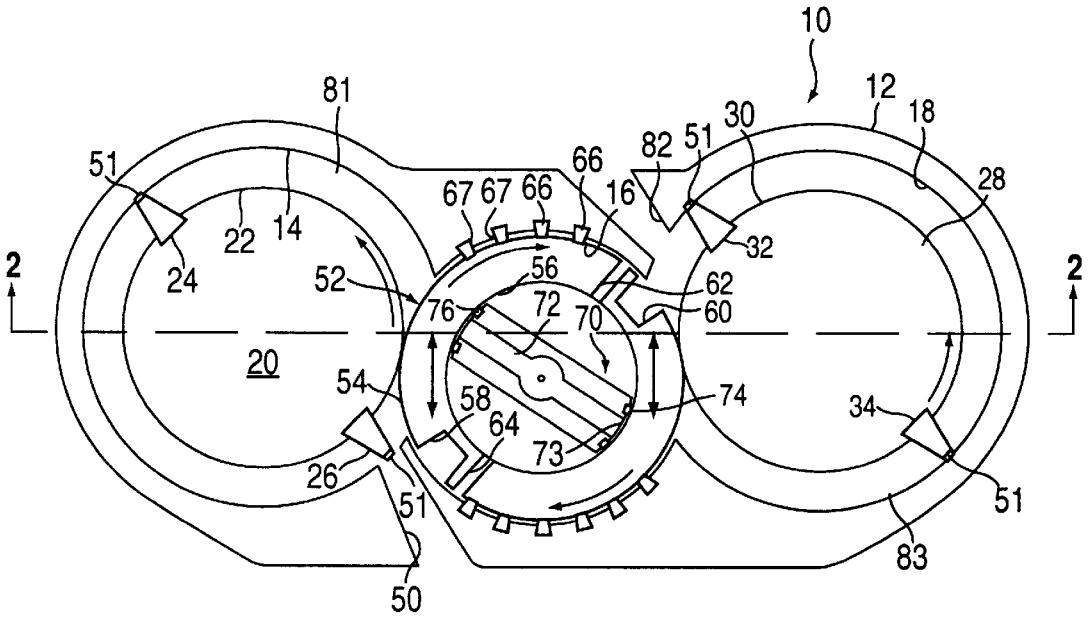
FIG. 1 is a sectional view of a rotary positive displacement engine constructed in accordance with the present invention.
Figure 3:
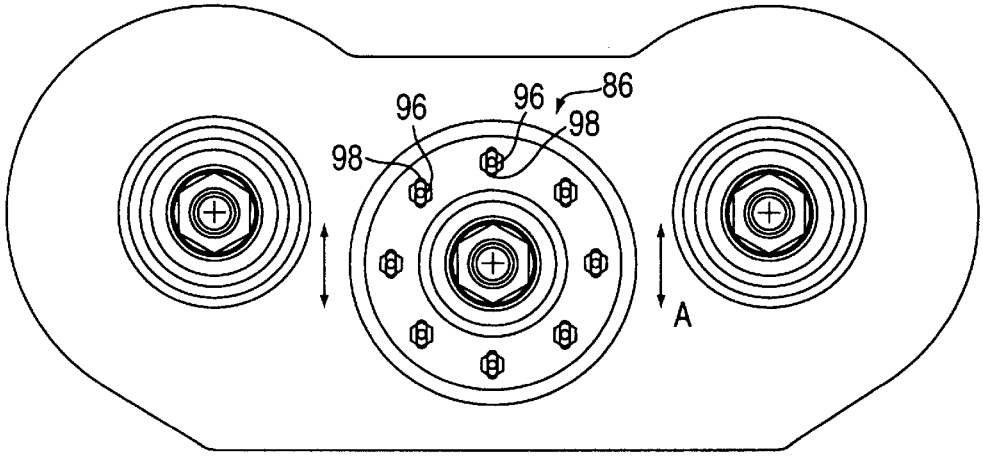
FIG. 3 is a rear view of the mounting arrangement for the barrier rotor of the present invention, with the rear cover and gearing removed.
Figure 2:
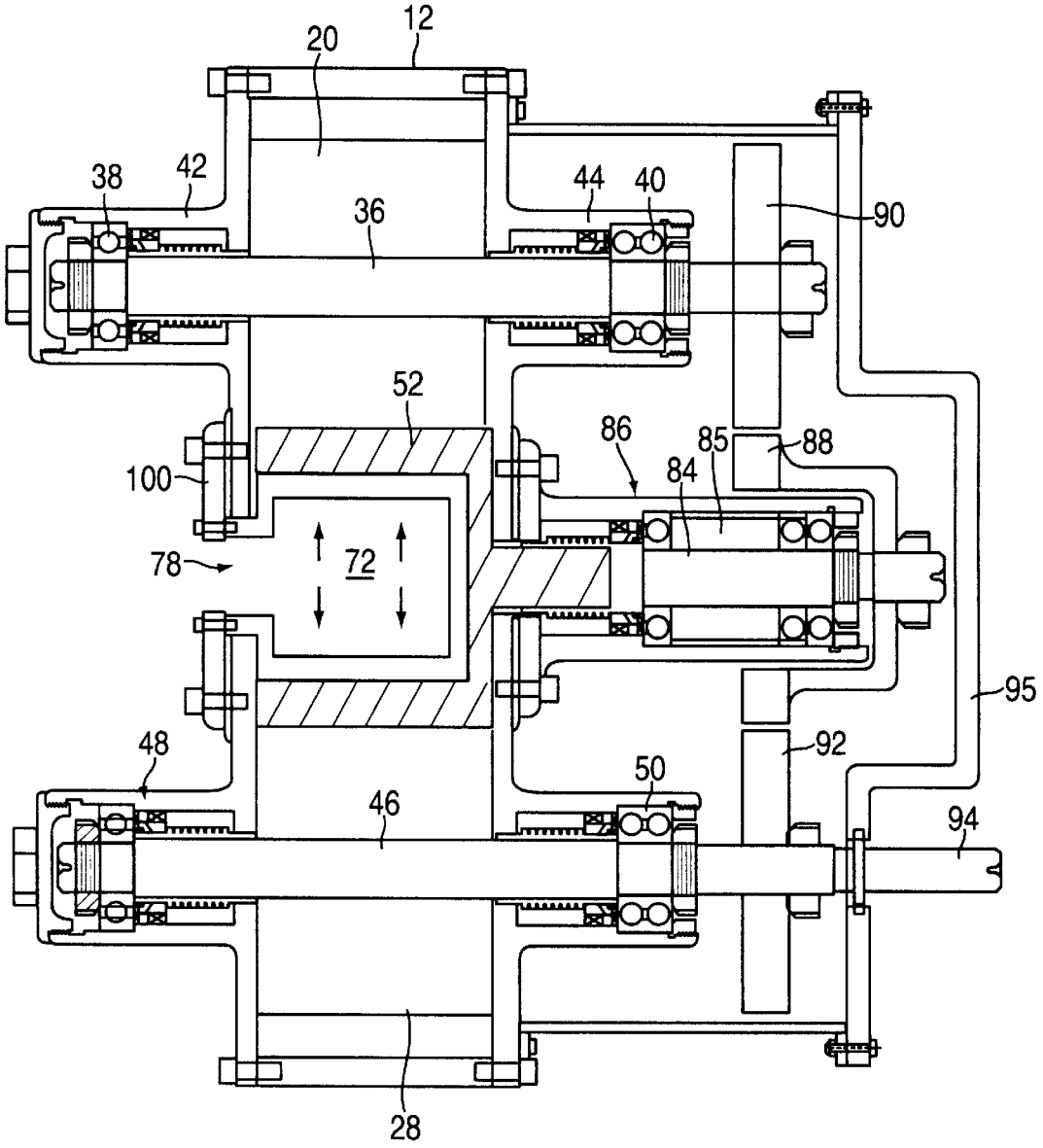
FIG. 2 is a plan view of the rotary positive displacement engine of the invention.

FIGS. 1–3 illustrate the rotary positive displacement expander (rotary engine) 10 constructed in accordance with the present invention. Rotary engine 10 includes a housing 12 having three overlapping cylindrical bores 14, 16 and 18. Journaled for rotation within bore 14 is a first power rotor 20 which has a cylindrical outer surface 22 of a diameter smaller than that of cylindrical bore 14, extending between outer surface 22 and bore 14 are a first 24 and a second 26 opposed vanes. A second power rotor 28 is journaled for rotation within cylindrical bore 18 and includes a generally cylindrical outer surface 30 and opposed vanes 32 and 34 extending between outer surface 30 and bore 18. As is best seen in FIG. 2, power rotor 20 is mounted to an axle 36 which is supported for rotation by bearing units 38 and 40 which are supported by a front plate 42 and a rear plate 44, respectively, of housing 12. Power rotor 28 is mounted for rotation by means of an axle 46 supported by a first bearing unit 48 and a second bearing unit 50. The tips of vanes 24, 26, 32 and 34 may include tip seals 51 to perfect the seal with cylindrical bores 14, 18.

Mounted for rotation within central cylindrical bore 16 of housing 12 is an annular barrier rotor 52 having an outer cylindrical surface 54 and an inner cylindrical surface 56. Disposed in cylindrical surface 54 of barrier rotor 52 are a first recess 58 and a second recess 60 which provide clearance to receive vanes 24, 26 of power rotor 20 and vanes 32, 34 of power rotor 28 as power rotors 20, 28 and barrier rotor 52 rotate synchronously. A first inlet port 62 and a second inlet port 64 leads from inner surface 56 to outer surface 54 of barrier rotor 52 and serve to deliver the powering charge to cylindrical bores 14, 18 to act on vanes 24, 26 of power rotor 20 and vanes 32,34 of power rotor 28 to cause the power rotors to rotate. The diameter of barrier rotor 52 is less than that of cylindrical bore 16 of housing 12 and a series of sealing strips 66 mounted in slots 67 in bore 16 extend to outer surface 54 of barrier rotor 52 to prevent any charge from passing between barrier rotor 52 and bore 16.

Fixed within the chamber formed within the inner cylindrical surface of barrier rotor 52 is a stator 70 which has opposed inlet ports 72,73 to deliver the charge to inlet ports 62,64 of barrier rotor 52 when the respective ports are aligned as barrier rotor 52 rotates about fixed stator 70. Sealing strips 74 are disposed on the outer surface 76 of stator 70 for engagement with the inner surface 56 of barrier rotor 52 so as to seal any outflow from ports 72,73 except when aligned with ports 62,64 of barrier rotor 52. As is shown in FIG. 2 an inlet port 78 in housing 12 delivers the powering charge, such as pressurized steam, from an external supply such as a boiler (not shown) to port 72 of stator 70 which will in turn deliver the charge to ports 62,64 of barrier rotor 52 and thereafter to act upon vanes 24, 26 of power rotor 20 and vanes 32,34 of power rotor 28 to cause the power rotors to rotate. An exhaust port 80 disposed in the side wall of bore 14 serves to remove the spent charge from power rotor 20 and an exhaust port 82 disposed in the side wall of bore 18 serves to remove the charge from power rotor 28.

As is shown in FIG. 2 barrier rotor 52 is joined to an axle 84 which is supported for rotation by means of a bearing 85 mounted within a sub-housing 86 which is supported on rear plate 44 of housing 12. The location of sub-housing 86 on rear plate 44 is adjustable, as will be discussed in detail below. Mounted to the end of axle 84 is a gear 88 which is mesh with a gear 90 mounted to the end of axle 36 which mounts power rotor 20. Gear 88 is also in mesh with a gear 92 joined to axle 46 which carries power rotor 28. Axle 46 is also joined to an output shaft 94, extending through a rear cover 95 of housing 12, which carries the output of rotary engine 10 to the device to be driven. As barrier rotor 52 is geared to power rotor 20 and power rotor 28 the three rotors will rotate synchronously.

Barrier rotor 52 performs two important functions, firstly it acts as a rotary valve to admit the powering charge to the power rotor when inlet ports 62,64 in barrier rotor are aligned with ports 72,73 in stator 70, secondly it seals exhaust ports 80,82 apart from the charge being injected to power rotors 20,28 so as to form an expansion chamber between the point of proximity of barrier rotor 52 with power rotors 20,28 and the vanes of power rotors 20 and 28. In FIG. 1 the expansion chamber of bore 14 (power rotor 20) is shown by reference number 81 and the expansion chamber of bore 18 (power rotor 28) is shown by reference number 83. In order to perform its sealing function, cylindrical surface 54 of barrier rotor 52 must be in close proximity to cylindrical surfaces 22,30 of power rotors 20 and 28. If the clearance is too large, a portion of the entering charge will blow by barrier rotor 52 and will be lost through exhaust ports 80,82. On the other hand if the clearance is too small, and the cylindrical surfaces of barrier rotor 52 and power rotors 20,28 touch; damage may occur, or at the very least, increased friction will result, which will also cause a loss of output power. As the clearance is also affected by the operating conditions of the motor 10 the clearance will change as rotary engine 10 assumes operating temperature. Thus, clearance adjustments made at rest will almost certainly be incorrect at operating temperature. The present inventive rotary engine can overcome these problems.

FIG. 3. Illustrates rear plate 44 of motor 10 with the gearing removed for the sake of clarity to illustrate the mounting of barrier rotor 52 to permit its adjustment with respect to power rotors 22 and 28. As described above barrier rotor 52 is mounted for rotation by means of sub-housing 86 which is mounted on rear plate 44 by a series of fasteners (bolts) 96 which ride in elongated openings 98 in sub-housing 86. Elongated Openings 98 are arranged so that the long side is positioned in the vertical direction as shown in FIGS. 1 and 3, so that the position of barrier rotor 52 can be adjusted along a vertical line A which is transverse to a line B joining the center lines of power rotors 22 and 28. As is shown in FIG. 1 the axis of rotation of barrier rotor 52 is positioned below that of power rotors 22,28 and its diameter is greater than that of the distance between cylindrical outer surface 22 of power rotor 20 and cylindrical outer surface 30 of power rotor 28. Thus movement of barrier rotor 52 in the vertical direction will adjust the clearance between outer surface 54 of barrier rotor 52 and outer surfaces 22, 30 of power rotors 20,28 respectively. Movement of barrier rotor 52 in an upward direction as shown in FIGS. 1 and 3 will decrease the clearance between barrier rotor and power rotors 20,28 and movement downwardly will increase the clearance.

As rotary engines are designed to operate at a specific operating temperature, adjustments to clearances made at room temperature will almost assuredly be incorrect at operating temperature as it is difficult to accurately predict just what effect different rates of thermal expansion of the various parts will have on the operational clearances. The present invention permits the critical barrier rotor to power rotor clearance to be adjusted at operating temperature. In this method power rotors 20 and 28 are mounted in housing 12 and the clearances of vanes 24,26,30, 34 are set so that power rotors 20,22 can rotate freely. Thereafter the entire engine is placed in an oven and permitted to heat soak so that all parts have been heated to operating temperature, the position of barrier rotor 52 is then adjusted by moving sub-housing 86 very slightly along elongated slots 98 so that cylindrical surface 54 of barrier rotor 52 just barely contacts cylindrical surfaces 22 and 30 of power rotors 20,22; bolts 96 are then tightened. Thereafter sealing strips 66 are inserted in slots 67 in bore 16 to seal barrier rotor 52 therewithin. Sealing strips are preferably constructed from a "sacrificial" material, such as bronze, which will abrade (wear away) slightly during rotation of barrier rotor 52 to further perfect the seal. The use of an abradeable material for sealing strips 74, located between barrier rotor 52 and stator 70, and vane tip seals 51 is also preferable for maximum efficiency of operation. After the position of barrier rotor 52 has been adjusted, stator 70 is inserted into barrier rotor 52 and attached to front plate 42 of housing 12 by means of a sub-housing 100.

The present invention is adaptable to rotor configurations other than a single barrier rotor with two power rotors. By way of example only, a simpler, more compact engine can be formed from a single power rotor and a single barrier rotor. Other configurations may utilize three or more power rotors and multiple barrier rotors. Furthermore, each power rotor herein has been illustrated as having two opposed blades, the present design will operate as well with only a single vane for each power rotor or with more than two vanes per power rotor. The present invention is suitable for high or low pressure operation as well as simple or compound configurations.

The invention has been described with respect to preferred embodiments. However, as those skilled in the art will recognize, modifications and variations in the specific details which have been described and illustrated may be resorted to without departing from the spirit and scope of the invention as defined in the appended claims.

What is claimed is:

1. A rotary positive displacement expander comprising:

a) a housing having at least first and second intersecting cylindrical bores disposed therein;

b) at least one power rotor mounted for rotation within said first cylindrical bore, said power rotor having a cylindrical outer surface of a diameter less than that of said cylindrical bore and at least one vane extending from the cylindrical outer surface of the power rotor to close proximity to the walls of the cylindrical bore;

c) an annular barrier rotor having cylindrical inner and outer surfaces and mounted for rotation within said second cylindrical bore within said housing, at least one port means extending between the inner and outer surfaces of the barrier rotor, the outer cylindrical surface of the barrier rotor being positioned in close proximity to the outer cylindrical surface of the power rotor;

d) external port means for fluid communication with the port means of said barrier rotor, said external port means communicating the powering charge to the barrier rotor; and e) the position of the axis of rotation of the barrier rotor being adjustable with respect to the axis of rotation of the power rotor, such that the clearance between the outer cylindrical surface of the power rotor and the outer cylindrical surface of the barrier rotor may be adjusted.

2. The rotary positive displacement expander as claimed in claim 1 when the external port means include a stator located within said annular barrier rotor, said stator having ports for fluid communication with the port means of said barrier rotor when said port means of the stator and barrier rotor are aligned at predetermined rotary positions of said barrier rotor.

3. The rotary positive displacement expander as claimed in claim 1 further including abradeable seals disposed between the outer cylindrical surface of the barrier rotor and the cylindrical bore in which the barrier rotor rotates.

4. The rotary positive displacement expander as claimed in claim 2 further including abradeable seals disposed between the inner cylindrical surface of the barrier rotor and the stator.

5. The rotary positive displacement expander as claimed in claim 1 further including exhaust ports disposed within the cylindrical bore in which the power rotor rotates.

6. The rotary positive displacement expander as claimed in claim 1 wherein the barrier rotor is mounted for rotation within said second cylindrical bore by means of a sub-housing adjustably mounted to the expander housing.

7. The rotary positive displacement expander as claimed in claim 6 wherein the sub-housing is mounted to the expander housing by means of fasteners carried in elongated slots to permit the location of the sub-housing to be adjusted with respect to the expander housing so as to thereby adjust the position of the barrier rotor.

8. The rotary positive displacement expander as claimed in claim 1 further including a third cylindrical bore disposed in said housing and a second power rotor mounted for rotation within said third cylindrical bore, said power rotor having a cylindrical outer surface of a diameter less than that of said third cylindrical bore and at least one vane extending from the cylindrical outer surface of the second power rotor to close proximity to the walls of the third cylindrical bore, the outer cylindrical surface of the second power rotor being positioned in close proximity to the outer cylindrical surface of the barrier rotor.

9. The rotary positive displacement expander as claimed in claim 1 wherein the power rotor includes two vanes located 180° apart on the outer cylindrical surface.

10. A rotary positive displacement expander comprising:

a) a housing having at least first and second intersecting cylindrical bores disposed therein;

b) at least one power rotor mounted for rotation within said first cylindrical bore, said power rotor having a cylindrical outer surface of a diameter less than that of said cylindrical bore and first and second opposed vanes extending from the cylindrical outer surface of the power rotor to close proximity to the walls of the cylindrical bore;

c) an annular barrier rotor having cylindrical inner and outer surfaces and mounted for rotation within said second cylindrical bore within said housing, at least one port means extending between the inner and outer surfaces of the barrier rotor, the outer cylindrical surface of the barrier rotor being positioned in close proximity to the outer cylindrical surface of the power rotor;

d) a stator located within the annular barrier rotor, said stator having port means for fluid communication with the port means of said barrier rotor when said port means of the stator and barrier rotor are aligned at predetermined rotary positions of said barrier rotor.

11. The rotary positive displacement expander as claimed in claim 10 further including a third cylindrical bore disposed in said housing and a second power rotor mounted for rotation within said third cylindrical bore, said power rotor having a cylindrical outer surface of a diameter less than that of said third cylindrical bore and at least one vane extending from the cylindrical outer surface of the second power rotor to close proximity to the walls of the third cylindrical bore, the outer cylindrical surface of the second power rotor being positioned in close proximity to the outer cylindrical surface of the barrier rotor.

12. The rotary positive displacement expander as claimed in claim 10 wherein the position of the axis of rotation of the barrier rotor is adjustable with respect to the axis of rotation of the power rotor, such that the clearance between the outer cylindrical surface of the power rotor and the outer cylindrical surface of the barrier rotor may be adjusted.

13. The rotary positive displacement expander as claimed in claim 12 wherein the barrier rotor is mounted for rotation within said second cylindrical bore by means of a sub-housing adjustably mounted to the expander housing.

14. The rotary positive displacement expander as claimed in claim 13 wherein the sub-housing is mounted to the expander housing by means of fasteners carried in elongated slots to permit the location of the sub-housing to be adjusted with respect to the expander housing so as to thereby adjust the position of the barrier rotor.

15. The rotary positive displacement expander as claimed in claim 10 further including abradeable seals disposed between the outer cylindrical surface of the barrier rotor and the cylindrical bore in which the barrier rotor rotates.

16. A rotary positive displacement engine, for powering from an external source of pressurized gas, comprising:

a) a housing having at least first, second and third intersecting cylindrical bores disposed therein;

b) a first and a second power rotor mounted for rotation within said respective first and second cylindrical bores, each of said power rotors having a cylindrical outer surface of a diameter less than that of their respective cylindrical bore and first and second opposed vanes extending from the cylindrical outer surfaces of the power rotors to close proximity to the walls of the cylindrical bore in which the power rotor is mounted;

c) an annular barrier rotor having cylindrical inner and outer surfaces and mounted for rotation within said third cylindrical bore within said housing, first and second port means extending between the inner and outer surfaces of the barrier rotor, the outer cylindrical surface of the barrier rotor being positioned in close proximity to the outer cylindrical surfaces of the first and second power rotors;

d) a stator located within the annular barrier rotor, said stator having port means for fluid communication with the port means of said barrier rotor when said port means of the stator and barrier rotor are aligned at predetermined rotary positions of said barrier rotors.

17. The rotary positive displacement engine as claimed in claim 16 wherein the position of the axis of rotation of the barrier rotor is adjustable with respect to the axes of rotation of the power rotors, such that the clearance between the outer cylindrical surfaces of the power rotors and the outer cylindrical surface of the barrier rotor may be adjusted.

18. The rotary positive displacement engine as claimed in claim 16 wherein the powering gas comprises steam.

19. The rotary positive displacement engine as claimed in claim 16 wherein the first and second power rotors and the barrier rotor are coupled together for synchronous rotation.

20. The rotary positive displacement expander as claimed in claim 16 further including abradeable seals disposed between the outer cylindrical surface of the barrier rotor and the cylindrical bore in which the barrier rotor rotates.

* * * * *